US010460607B2

(12) United States Patent
Poisson et al.

(10) Patent No.: US 10,460,607 B2
(45) Date of Patent: Oct. 29, 2019

(54) PREDICTIVE MULTIMODAL LAND TRANSPORTATION SUPERVISION

(71) Applicant: Alstom Transport Technologies, Saint-Ouen (FR)

(72) Inventors: Pascal Poisson, Sceaux (FR); Manel Abid, Paris (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 280 days.

(21) Appl. No.: 15/430,736

(22) Filed: Feb. 13, 2017

(65) Prior Publication Data

US 2017/0236424 A1 Aug. 17, 2017

(30) Foreign Application Priority Data

Feb. 12, 2016 (FR) ..... 16 51164

(51) Int. Cl.
*G08G 7/00* (2006.01)
*G08G 1/00* (2006.01)
(Continued)

(52) U.S. Cl.
CPC ..... *G08G 1/20* (2013.01); *G08G 1/0141* (2013.01); *G08G 1/0968* (2013.01); *G08G 1/127* (2013.01); *G08G 7/00* (2013.01)

(58) Field of Classification Search
CPC . G08G 7/00; G08G 9/00; G05D 1/0287–0297
See application file for complete search history.

(56) References Cited

U.S. PATENT DOCUMENTS 8,700,440 B1 * 4/2014 Ande ..... G06Q 50/30 705/7.22
2004/0088104 A1 * 5/2004 Izbicki ..... G08G 1/123 701/117
(Continued)

FOREIGN PATENT DOCUMENTS

EP 2637148 A1 9/2013
FR 3010566 A1 3/2015
(Continued)

OTHER PUBLICATIONS

French Patent Application No. 16 51164, Rapport de Recherche Préliminaire, Nov. 3, 2016, 3 pages.
(Continued)

*Primary Examiner* — Genna M Mott
(74) *Attorney, Agent, or Firm* — Soquel Group LLC

(57) ABSTRACT

This infrastructure is characterized in that the multimodal network grouping together a plurality of monomodal networks, each monomodal network being equipped with an individual operating system, the supervision infrastructure includes a plurality of local supervision modules, each local supervision module being associated with a transfer station providing an interconnection between at least two of the monomodal networks and being able to perform a real-time synthesis of the traffic at the associated transfer station and continuously execute a plurality of operating rules by using operating data from the traffic synthesis so as to generate at least one setpoint, and to send the setpoint to at least one operating system of one monomodal network from among the monomodal networks interconnected to the associated transfer station.

8 Claims, 1 Drawing Sheet

(51) Int. Cl.

| | |
|---|---|
| ***G08G 1/01*** | (2006.01) |
| ***G08G 1/0968*** | (2006.01) |
| ***G08G 1/127*** | (2006.01) |

(56) References Cited

U.S. PATENT DOCUMENTS

| | | | | |
|---|---|---|---|---|
| 2013/0144467 | A1 | 6/2013 | Kickbusch et al. | |
| 2015/0170031 | A1* | 6/2015 | Attar | G07C 5/0858 706/46 |

FOREIGN PATENT DOCUMENTS

| | | | |
|---|---|---|---|
| GB | 2378560 | A | 2/2003 |
| WO | 1998008206 | A2 | 2/1998 |
| WO | 1998008206 | A3 | 4/1998 |
| WO | 20090076216 | A2 | 6/2009 |
| WO | 20090076216 | A3 | 9/2009 |
| WO | 20130096675 | A1 | 6/2013 |

OTHER PUBLICATIONS

EP Application No. 17155632, EPO Rapport de Recherche Europeene, Jun. 20, 2017, 2 pp.

* cited by examiner

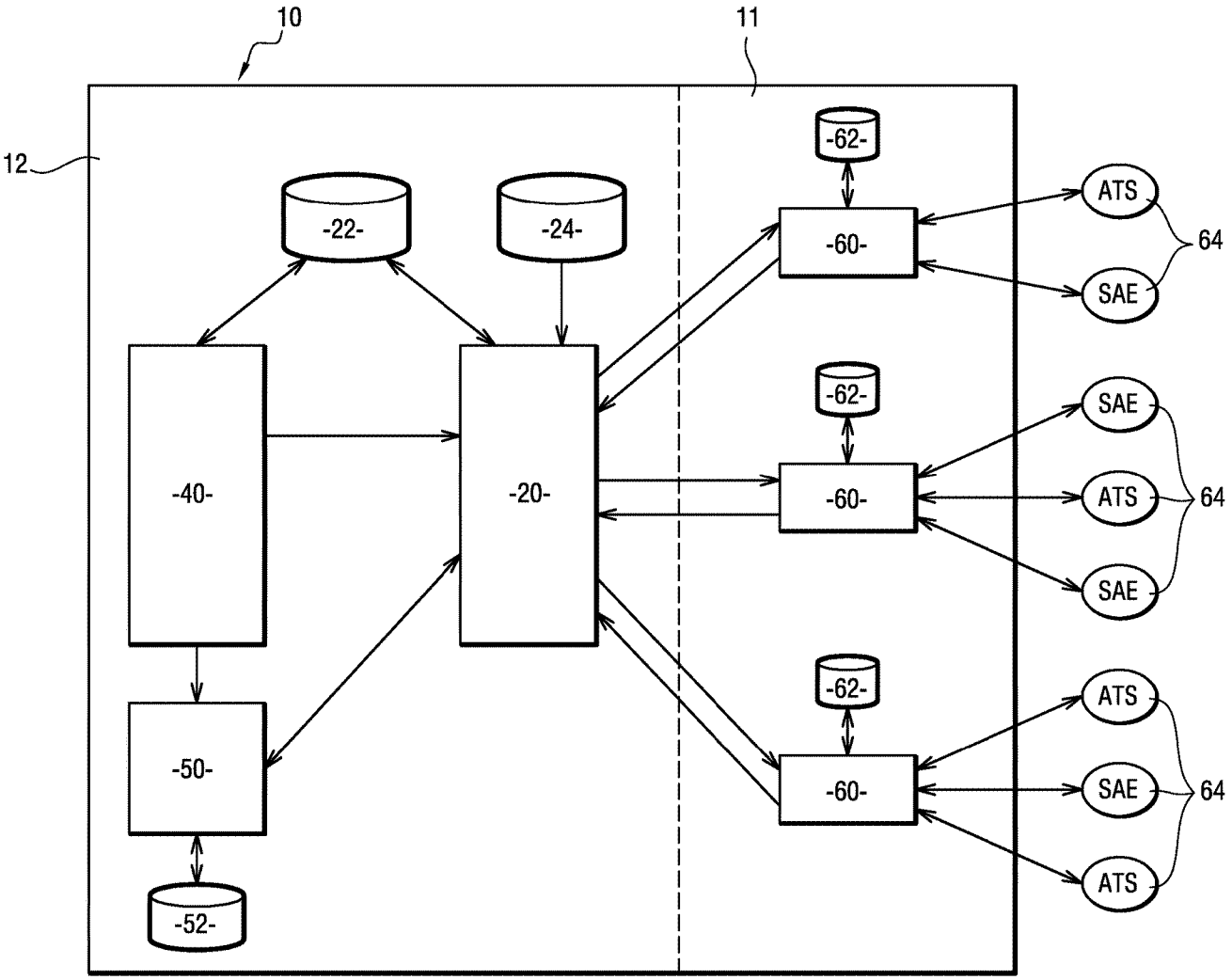
64
ATS
SAE
SAE
ATS
SAE
ATS
SAE
ATS
64
64
-62-
-60-
-62-
-60-
-62-
-60-
11
-24-
-20-
-22-
10
-40-
-50-
-52-
12

PREDICTIVE MULTIMODAL LAND TRANSPORTATION SUPERVISION

CROSS REFERENCE TO RELATED APPLICATIONS

This application claims priority under 35 USC § 119 of French Patent Application No. 16 51164 filed on Feb. 12, 2016.

FIELD OF THE INVENTION

The invention relates to the field of predictive multimodal land transportation supervision.

BACKGROUND OF THE INVENTION

In large cities, different public transportation services are offered to users: trains, subways, trams, buses, etc.

These services are managed independently of one another, most often by different operators.

In this document, a monomodal network is a network on which vehicles belonging to a single mode of transportation travel: for example the subway, bus, tram, train. The operator of a monomodal network sees to service on this monomodal network based on a transportation plan, i.e., a plan for serving stops, associated with a timetable or passage frequency. An operator often manages a set of monomodal networks with no effective synchronization between them.

In general, a monomodal network is characterized by the existence of a centralized operating system making it possible to manage traffic on the corresponding monomodal network. An operating system uses timetables to control the movement of each vehicle traveling on the monomodal network. A timetable defines the departure times from each station on the line, the normal travel times between two stations on the line, the normal parking times, etc. A timetable is updated dynamically during the travel of the corresponding vehicle with operating information, for example the interval with the vehicle preceding the vehicle in question, the time necessary to transfer users during a stop at the station, etc.

A multimodal land transportation network is, by definition, a network that groups together different monomodal networks and allows the user to go from a departure station to an arrival station using one or several public transportation services.

However, in such a multimodal network, it is difficult for a user to minimize his travel time between a departure station and an arrival station effectively, in particular when this journey includes a transfer between two services; i.e., a station allowing a user to exit a first vehicle serving a first line of a first monomodal network to enter a second vehicle serving a second line of a second monomodal network.

The user can for example try to plan his trip by querying a database aggregating the theoretical schedules for the different services. However, the services being managed independently, the theoretical schedules are not correlated and may lead to an extended wait time in the transfer station.

Furthermore, the theoretical schedules are difficult to respect, such that during the trip, if the first vehicle is late, the second vehicle may have left the transfer station before the first vehicle has arrived. Consequently, the user misses his transfer and is required to wait for the next vehicle serving the second line or to redefine his trip. The frequency of vehicles on certain lines being low, the wait time for the user may be substantial.

Therefore, even when he has optimized his trip, the user is required to take a trip with an extended duration. The quality of service perceived by the user is therefore not optimal.

To avoid this type of situation caused by independently-managed transportation services, there is therefore a need to supervise the operation of the multimodal transportation network.

SUMMARY OF THE DESCRIPTION

The invention therefore aims to meet this need, in particular by proposing an infrastructure for supervising a multimodal land transportation network.

The invention relates to a supervision infrastructure as defined by the appended set of claims.

BRIEF DESCRIPTION OF THE DRAWINGS

The invention will be better understood upon reading the following description, provided solely as a non-limiting example and done in reference to FIG. 1, which is a schematic illustration of the infrastructure according to the invention.

DETAILED DESCRIPTION

The supervision infrastructure 10 in the FIGURE serves to allow the supervision of the operation of a multimodal land transportation network as defined above.

The multimodal network groups together a plurality of monomodal networks, each monomodal network including a plurality of lines on which vehicles of the same type travel.

Transfer stations, shared by at least two lines from two different monomodal networks, make it possible to transfer users from one line to another.

A transfer station thus allows a user to transfer between a first line served by first vehicles of the first monomodal network and a second line served by second vehicles of the second monomodal network.

Each monomodal network is equipped with a traditional operating system allowing dynamic operation of the circulating vehicles. Such an operating system is able to determine timetables dynamically for each of the circulating vehicles at the current moment, in particular from operating data.

The supervision infrastructure 10 makes it possible to have a global view of the traffic on the multimodal network and optimize the operation of each of the monomodal networks accordingly.

The supervision infrastructure 10 interfaces with the existing operating systems of the different monomodal networks to offer supervision of the multimodal network. In particular, the supervision infrastructure 10 leads to the generation of setpoints for the operation of a particular monomodal network, these setpoints being taken into account by the operating system of the monomodal network in question, as operating data, to develop timetables for the circulating vehicles.

The supervision infrastructure 10 dynamically provides an individual operating system with operating data outside the monomodal network in question. The operating system modifies the timetable of a supervised vehicle and/or its movement dynamics (i.e., by adapting the travel speed between two stations) accordingly, while keeping an eye on the operation of the corresponding monomodal network, if only for operating safety reasons.

The supervision infrastructure 10 includes a first level 11 and a second level 12.

The first level 11, which is decentralized, includes a plurality of local supervision modules 60. Each module 60 is associated with a traffic database 62 including traffic data. The different modules 60 are connected to one another and to a global supervision module 20 of the second level 12 via an appropriate communication network.

The second level 12, which is centralized, includes a global supervision module 20, an operational data management module 40 and a crisis management module 50.

The second level 12 also includes a history database 22, an operating rules database 24, and a scenario database 52.

First Level

The first level 11 is used to assess the local situation at each of the transfer stations of the multimodal network and to manage the local traffic at each of the transfer stations.

Each local supervision module 60 is associated with a transfer station of the multimodal network.

A module 60 is interfaced with each of the individual operating systems 64 of the monomodal networks whose lines intersect at the transfer station associated with the module 60. For example, as shown in the FIGURE, a module 60 is interfaced with one or several ATS (Automatic Train Supervision) operating systems, traditional in a monomodal network of the subway or tram type, and with one or several EAS (Exploitation Aided System) operating systems, traditional in a monomodal network of the bus type.

More generally, the different monomodal networks aggregated within the multimodal network must at least be based on the operation of dynamic timetables, and preferably dynamic timetables that can be adjusted with a short response time, typically about one second.

A module 60 is able to perform a real-time synthesis of the local traffic at the transfer station that it equips, from information communicated to it by the operating systems with which it is interfaced, in particular the different timetables of the circulating vehicles, as well as by the other modules 60. The data relative to the local traffic synthesis is stored in the database 62 associated with the considered module 60.

A module 60 implements local management mechanisms for the traffic at the transfer station that it equips, in particular synchronization mechanisms between the vehicles of the different monomodal networks arriving at and departing from this transfer station.

To that end, a module 60 executes a set of multimodal operating rules making it possible to develop at least one operating setpoint of a particular monomodal network from the local traffic synthesis.

The set of operating rules that a module 60 must execute at the current moment is provided to it by the global supervision module 20 based on an operating profile of the multimodal network, as will be described below. It is this set of rules that defines the management mechanisms implemented by the module 60.

For example, for a "nominal" operating profile, a module 60 verifies a set of rules allowing synchronization between two lines of two multimodal networks intersecting in the transfer station associated with the module 60 in question.

This set of rules for example consists of delaying the departure of a second transfer vehicle by using the time margin set out in the operating plan for the corresponding line.

More specifically, among the local traffic synthesis information, the module 60 periodically estimates the delay with which a first vehicle will reach the transfer station.

From this estimated delay, the module 60 develops a setpoint consisting of delaying the departure time of a second vehicle from the transfer station, relative to the departure time set out in the current timetable of this second vehicle.

The setpoint is then sent to the operating system supervising the travel of the second vehicle. The operating system then updates the timetable of the second vehicle taking the setpoint into account, in addition to the information that it traditionally takes into account to supervise the movement of the second vehicle.

The second vehicle belonging to the second monomodal network is thus kept at the station to account for the delay of the first vehicle of the first monomodal network, so as to allow the users of the first vehicle to exit the first vehicle and board the second vehicle.

However, the introduction of the delay in the departure time of the second vehicle must not create excessive disruptions downstream of the transfer station in question (avalanche effect). Thus, the operating rule executed by the module 60 makes it possible only to delay the departure of the second vehicle if it remains below an operating margin predetermined by the operator of the second monomodal network.

If the local supervision module 60 cannot retain the second vehicle any longer despite the fact that the first vehicle has not yet arrived, the second vehicle leaves without waiting for the arrival of the first vehicle. The module 60 sends the global supervision module 20 the fact that a set of operating rules has not been respected. The module 20 will then be required to analyze the causes of this anomaly and optionally deploy new operating rules so as to better manage the traffic to allow the transfer between the two monomodal networks at the transfer station in question.

The operating rule is updated once the value of the estimated delay for the first train is modified by the local traffic synthesis.

Each time the setpoint on the departure time of the second train is modified, this data is propagated to the other modules 60 so that they update their local traffic database 62, when such data is relevant for the implemented operating rules.

Once the second train actually leaves the station, the module 60 stops updating the setpoint on the corrected departure time of the second vehicle and sends this data to the other local supervision modules 60 and the relevant operating system.

Different types of rules or groups of rules can be implemented to modify the timetables dynamically, redefine a vehicle's assignment, modify the dynamics of a vehicle between two stations, etc. More generally, a setpoint can be generated by a rule or a group of rules to influence any of the parameters that the operating system is able to adjust.

Second Level

The second level 12 is used to assess the global situation on the entire multimodal network and to manage the multimodal network using a transportation plan.

The global supervision module 20 is configured to work in three possible modes.

In a first operating mode or nominal mode, the module 20 selects an operating profile of the multimodal network automatically or through operator intervention, and based on a plurality of parameters.

In the operating database 24, each profile is associated with the sets of operating rules that each of the modules 60 must execute when the profile in question is selected.

For example, among the predefined profiles, there is a "peak hours" profile, the operating rules of which give priority to the user flows (favoring circulation along a line used by a large number of users), an "off-peak hours" profile, the operating rules of which make it possible to give priority to stations with little service (delaying a train having a low frequency to allow users to make their connection), or an energy saver profile (circulating a train with a delay not by holding at a station, but by limiting its speed between two stations).

The parameters for selecting a profile for example include the time of day to determine whether it involves off-peak hours or peak hours, etc.

Once a profile is selected, the rules associated with the corresponding profile are read in the database 24 and sent to each of the modules 60 for execution.

It should be noted that the operating rules are predefined in the database 24. Each rule results from an operating analysis between the various operators of the monomodal networks affected by the implementation of the corresponding rule and the operator of the multimodal network.

In a second operating mode or "overload" mode, the supervision module 20 analyzes the evolution of the behavior of the network from characteristic events.

More specifically, the operational data management module 40 is able to determine an instantaneous state of the traffic on the multimodal network. The instantaneous state of the traffic may for example consist of a plurality of variables, each variable being associated with a load level at a point of the multimodal network.

To that end, the module 40 collects data from different information sources. This data can be operating data delivered by the supervision systems of the monomodal networks, contextual operating data, such as weather data, or monitoring data delivered by cameras. This information of different types is aggregated by the module 40 to obtain an instantaneous state.

The instantaneous state is stored in the history database 22.

The module 40 is able to compare the instantaneous state with a previous state in order to determine changes in the instantaneous state of the traffic, in particular variations in the load level. Such state change information is next compared to similar information stored in the history database 22 so as to identify characteristic events that are precursors of a traffic overload situation.

The identified characteristic events are sent in real time to the global supervision module 20.

Based on the type of characteristic event received, the module 20 is then able to take countermeasures making it possible to avoid saturation and avalanche phenomena.

These countermeasures consist of deploying new operating rules, on a case-by-case basis, on one or the other of the modules 60. Once again, these rules are predefined in the operating rules database 24.

These new operating rules executed by the different local supervision modules 60 make it possible to best preserve the transportation capacity of the network, to avoid congestion that may deteriorate the overall performance thereof.

This operating mode is intended to handle malfunctions such as recurring traffic delays or bottlenecks identified within the multimodal network.

In a third operating mode or downgraded mode, the global supervision module 20 supervises the multimodal network when part of that network is unavailable, for example in case of passenger incident or unavailable infrastructure.

When the module 40 has identified a characteristic event indicative of a failure, a situation file is sent to the module 50. Likewise, a module 60 can escalate a major disruption to the module 20.

The database 52 includes different predefined reconfiguration scenarios for the multimodal network. Each scenario is associated with a situation file and a situation file is associated with a plurality of possible reconfiguration scenarios. For example, if an overload is detected on a line at a station, the scenario may consist of avoiding the use of the corresponding means of transportation during a determined duration, holding the vehicles on the affected line in the upstream stations, or commissioning vehicles on a diversion line.

The module 50 is then able to analyze the impact of the implementation of each of the scenarios associated with the situation file on the management of the detected failure. A prospective algorithm is for example executed on each of these scenarios to determine the best among them, taking into account relevant operating parameters, for example the reduction of the reconfiguration time of the multimodal network or the return to normal traffic or the resynchronization of the different transfer stations of the multimodal network.

The scenario leading to maximization of the capacity of the multimodal network is selected as the best possible scenario. The module 50 therefore makes it possible to anticipate the effect of the implementation of a scenario on the traffic state. The module 50 constitutes a decision aid for the operator. The scenario making it possible to offer the best response to the failure in terms of traffic state is chosen by the operator and sent to the global supervision module 20.

More specifically, each scenario being associated with a plurality of operating rules in the database 52, the operating rules associated with the best scenario are sent by the module 20 to each of the modules 60 such that they implement them to effectively reconfigure the operation of the multimodal network, for example by making a section of a line of a monomodal network unusable, redefining assignments and consequently timetables for the vehicles circulating on this monomodal network or the neighboring monomodal networks, or commissioning bypass lines and replacement vehicles.

Of course, depending on the needs, additional modes may be defined.

The invention claimed is:

1. A supervision infrastructure for a multimodal land transportation network that groups together a plurality of monomodal land transportation networks, wherein each monomodal land transportation network is equipped with an individual operating system, the supervision infrastructure comprising:

a plurality of local supervision modules, each local supervision module being associated with a transfer station providing an interconnection between at least two of the monomodal land transportation networks, and wherein each local supervision module is configured to:

perform a real-time traffic synthesis of traffic at the associated transfer station, execute continuously a plurality of operating rules by using operating data from the real-time traffic synthesis to generate at least one setpoint, and send the at least one setpoint to at least one operating system of at least one monomodal land transportation network from among the monomodal land transportation networks interconnected to the associated transfer station, and a global supervision module configured to send, to each of said local supervision modules, the plurality of operating rules that the local supervision module must execute, wherein the plurality of operating rules sent to one local supervision module differs from the plurality of operating rules sent to another local supervision module.

2. The supervision infrastructure according to claim 1, wherein said global supervision module determines the plurality of operating rules based on an operating profile of the multimodal land transportation network, the operating profile corresponding to an implementation of an operating priority of the multimodal land transportation network.

3. The supervision infrastructure according to claim 2, wherein the operating priority is chosen from among:

a priority given to a travel time of users through the multimodal land transportation network;

a priority given to a flow of passengers through the multimodal land transportation network;

a priority given to an energy consumption of vehicles circulating on the multimodal land transportation network; and other priorities developed by an operator of the multimodal land transportation network.

4. The supervision infrastructure according to claim 1, wherein said global supervision module operates in a mode selected from among a nominal operating mode, an overload operating mode, to avoid an occurrence of an overload at a point of the multimodal land transportation network, and a downgraded operating mode, to account for a failure on the multimodal land transportation network.

5. The supervision infrastructure according to claim 1, further comprising:

an operational data management module configured to aggregate information:

to determine a current state of traffic on the multimodal land transportation network and;

to compare the current state with a preceding state to identify a characteristic event that indicates an occurrence of an overload on the multimodal land transportation network, wherein said global supervision module is configured to deploy, based on the characteristic event identified, on the different local supervision modules, operating rules comprising countermeasures making it possible to cancel the overload.

6. The supervision infrastructure according to claim 1, further comprising:

a scenario database associating a failure on the multimodal land transportation network with a plurality of operating scenarios of the multimodal land transportation network, and associating each operating scenario with a set of operating rules; and a crisis management module configured to determine, when a particular failure occurs, an expected impact of each operating scenario of the plurality of operating scenarios associated with the particular failure on the state of traffic on the multimodal land transportation network, so as to help an operator choose the best operating scenario from the plurality of operating scenarios associated with the particular failure, wherein said global supervision module is configured to send the operating rules associated with the best operating scenario to each of said local supervision modules.

7. The supervision infrastructure according to claim 1, wherein an operating rule comprises keeping a second vehicle in a station as long as a first vehicle has not arrived at the station, as long as a retention time of the second vehicle does not exceed a predetermined margin.

8. The supervision infrastructure according to claim 1, wherein an operating rule comprises acting on a travel time of a vehicle between two stations and/or an assignment of one or several vehicles in order to maximize capacity of the multimodal network.

* * * * *